United States Patent [19]

Twyman

[11] 4,451,352

[45] May 29, 1984

[54] PROCESS OF PRODUCING OIL BY PYROLYSIS

[75] Inventor: Noel H. Twyman, Canyon Lake, Calif.

[73] Assignee: Automated Production Systems Corporation, Tustin, Calif.

[21] Appl. No.: 285,038

[22] Filed: Jul. 20, 1981

[51] Int. Cl.[3] ..... C10G 1/00

[52] U.S. Cl. ..... 208/11 R; 208/8 R; 201/32

[58] Field of Search ..... 208/11 R, 8 R; 201/32, 201/33, 37, 44; 202/88, 100, 113, 116, 108, 118, 135

[56] References Cited

U.S. PATENT DOCUMENTS

| | | | |
|---|---|---|---|
| 1,916,900 | 7/1933 | Vandegrift et al. | 208/11 R X |
| 2,435,746 | 2/1948 | Jones | 208/11 R X |
| 2,441,380 | 5/1948 | Berg | 208/11 R X |
| 2,664,389 | 12/1953 | Rex et al. | 208/11 R X |
| 3,058,903 | 10/1962 | Otis | 208/11 R |
| 3,336,104 | 8/1967 | Miller | 208/11 R |
| 3,888,621 | 6/1975 | Williams | 201/32 X |
| 3,966,560 | 6/1976 | Farago et al. | 201/32 |
| 4,038,153 | 6/1975 | Dervelle et al. | 201/32 X |
| 4,058,205 | 11/1977 | Reed, Jr. | 208/11 R X |

*Primary Examiner*—Delbert E. Gantz
*Assistant Examiner*—Glenn Caldarola
*Attorney, Agent, or Firm*—Edward D. O'Brian; K. H. Boswell

[57] ABSTRACT

Oil is preferably recovered from oil shale through the use of a process involving two separate heating steps. During the first of these steps the shale is heated by contact with a hot gas stream while it is agitated for a period and at a temperature which together are such that any significant further heating will cause the vaporization of pyrolysis products of the kerogen within the shale. During the second heating step the shale is further heated by contact with a hot gas stream while being agitated for a period and to a temperature which together are sufficient to produce and volatilize substantially all of the volatiles which can be obtained from or derived from the shale. After the second heating step the vaporized products and the remaining inorganic mineral matrix are separated, and the volatiles are recovered as oil.

12 Claims, 1 Drawing Figure

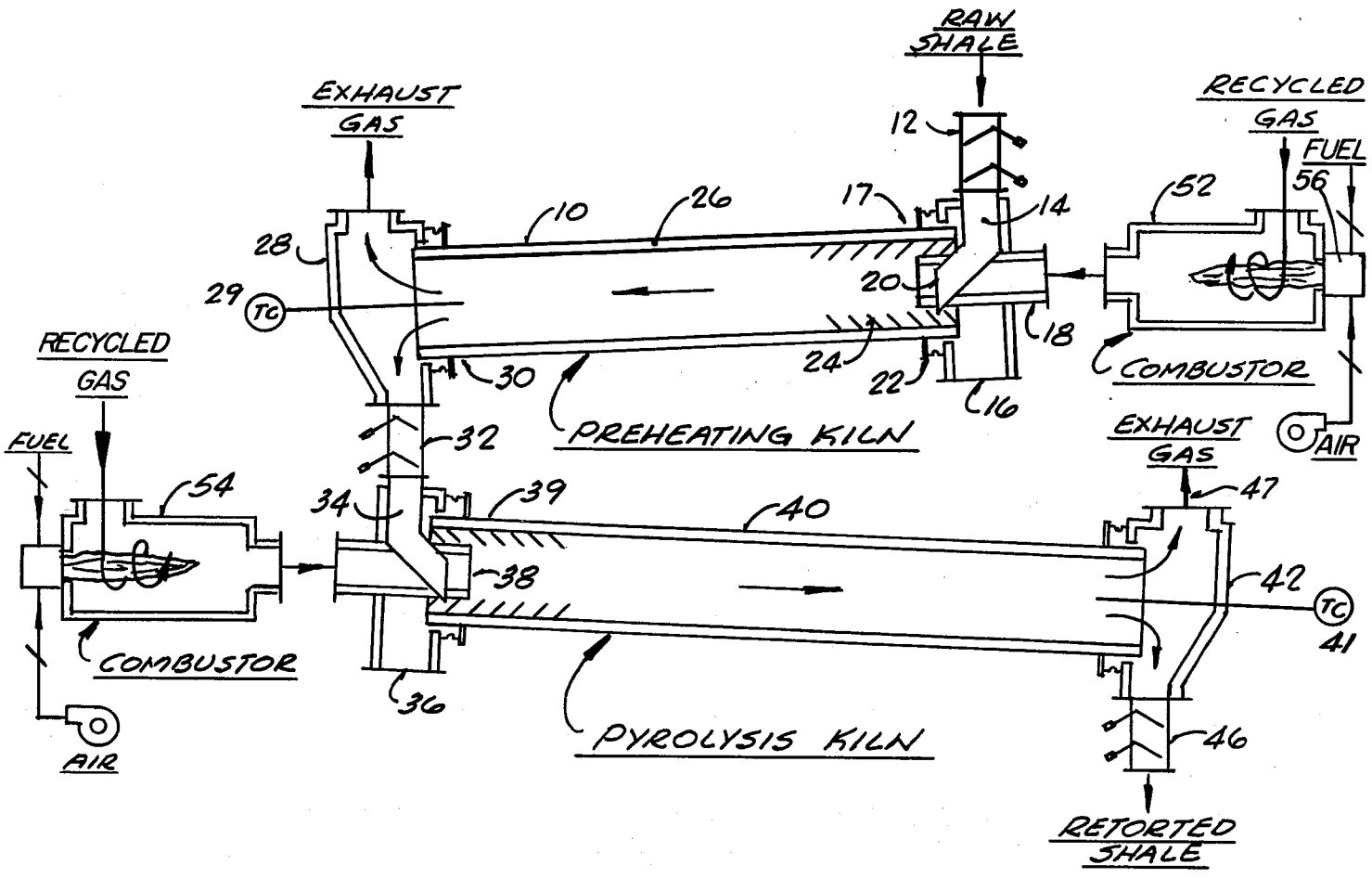
RECYCLED GAS
FUEL
56
AIR
COMBUSTOR
52
EXHAUST GAS
47
42
TC
41
46
RETORTED SHALE
RAW SHALE
12
14
18
16
17
20
22
24
26
10
PREHEATING KILN
40
PYROLYSIS KILN
39
38
30
32
36
34
EXHAUST GAS
28
29
TC
54
RECYCLED GAS
FUEL
COMBUSTOR
AIR

PROCESS OF PRODUCING OIL BY PYROLYSIS

BACKGROUND OF THE INVENTION

The invention set forth in this specification pertains to a new and improved process for recovering hydrocarbon compounds from naturally occurring deposits of a mineral matrix permeated or interpolated with kerogen or other similar or related substances. The process of this invention is considered to be of primary utility in connection with the recovery of oil and oily compounds from oil shale, but is also capable of being utilized in recovering the same or similar compounds from other, reasonably related, naturally occurring materials, such as tar sands and the like.

Because of primarily economic considerations, increasing attention is being paid to the possibility of recovering various hydrocarbon compounds which collectively may be referred to as an "oil" from naturally occurring oil shale. Such oil shale consists of an inorganic or mineral matrix in the nature of a conventional shale type rock permeated or interpolated with an essentially hydrocarbon type material commonly referred to as kerogen. It has long been recognized that an oil type of composition can be obtained by heating such kerogen to a sufficient extent so as to cause what is loosely referred to as pyrolysis of the kerogen.

This term "pyrolysis" is considered to be to a degree both accurate and misleading. As a practical matter, it is known that when kerogen is heated to a sufficient temperature and for a sufficient time to cause not well identified reactions it produces volatile or so-called "pyrolysis products". This term "volatile" as used in the preceding is intended to indicate the production of various compounds from either a liquid solid state to a gaseous or vapor state as a result of the application of heat. It will be recognized that this term as used in this manner encompasses both the vaporization of liquids in the form of a mist or the like, as well as the gasification of various compounds. Normally only decomposition products will be vaporized.

Any liquid vaporized as a result of pyrolysis of an oil shale is normally considered to be derived or produced as a result of degradation of the kerogen, presumably as a result of the kerogen first being degraded to a type of composition known as bitumen and then subsequently as a result of the bitumen breaking down into various compounds which are present at the time as gases and other compounds which pass into the ambient atmosphere as finally divided particles constituting a mist. It is considered that any such consideration of the chemistry involved is somewhat misleading. It can be argued if such bitumen is in fact formed. It is possible that some of the vaporized compounds recovered are found in the kerogen in the form in which they are vaporized. It is possible that some of the vaporized compounds are not merely the product of degradation reactions, but are reaction products of compounds produced as a result of the degradation reactions, and so on.

These factors are considered important in understanding that the chemistry involved in the production of oil from oil shale and other related deposits is not simple and is not completely understood. The specific reactions involved in the recovery of oil from such deposits by pyrolysis unquestionably will vary depending upon the specific mineral deposit being pyrolyzed; because of the variations in the inorganic matrices and the kerogen in such deposits; because of the manner in which kerogen is interpolated or permeated within such matrices and probably because of other factors. Such chemistry is believed to be capable of being influenced by the presence of inorganic materials within the mineral matrix or added to the pyrolyzed material tending to promote or cause various reactions facilitating or hindering the recovery of organic compounds from the kerogen.

A wide variety of different processes have been developed and to various extents used or tested for the purpose of recovering oil or oily compounds from various different naturally occuring deposits as noted in the preceding. It is not considered that an understanding of the present invention requires a detailed comparison of the present invention with any of such prior processes or any sort of a discussion specifically delineating why the present invention is more desirable in various ways than various specific known processes. It is, however, believed that it will be desirable to recognize that various prior processes for the noted purpose all have various limitations or disadvantages of different sorts.

It has long been recognized that any desirable process for recovering an oil or oil-like composition from naturally occurring deposits should include a number of desirable, advantageous features or aspects or characteristics. It is well recognized that any desirable process of this type should be continuous and should be capable of processing a comparatively large amount of mineral material in a comparatively minimally sized "apparatus". Further, it has long been recognized it will be desirable for any process of the type noted to be reasonably self-efficient from an energy requirement standpoint because of fuel costs. Any plant to practice a process for recovering such oil or oily compounds should require only a comparatively limited capital investment, and in addition, should be mechanically simple and easy to operate at a very nominal or minimal cost.

It has also been recognized that any process for the noted purpose should be capable of being practiced using either little or no water. Further, it is acknowledged that any process of the type noted to be desirable should be capable of being utilized with particles of a wide variety of different sizes with substantially the same efficiency regardless of the variation in the sizes of the particles. Also, because of environmental concern, a process for the recovery of oil or oily compounds from minerals such as oil shale should not cause any significant environmental problems, and in particular, should not cause any permanent environmental damage.

BRIEF SUMMARY OF THE INVENTION

An objective of the present invention is to provide a new and improved process for recovering hydrocarbon compounds from naturally occurring deposits of a mineral matrix permeated or interpolated with kerogen which is more desirable than any other known process for the same or substantially the same purpose. More specifically, the invention is intended to provide a process as indicated which is more desirable in accordance with various criteria as are indicated in the preceding discussion than any other prior, related processes for the same or substantially the same purpose.

Because of the nature of these generalized objectives of the present invention it is not considered necessary to encumber this specification with a prolonged, detailed listing of all specific aspects of a process of the present invention which are considered desirable or beneficial. A mere listing of such matters would do little to further an appreciation or understanding of the present invention. Many different specific features or aspects of the present invention which are important or desirable will be apparent from a consideration of the subsequent detailed description.

The present invention concerns a process for recovering or obtaining hydrocarbon compounds from naturally occuring deposits of a mineral matrix interpolated with kerogen which includes heating the raw material employed for a period and at a temperature which together are sufficient so that pyrolysis products from the kerogen are produced and volatilized and then separating these products from the remainder of the mineral matrix in which the improvement comprises: the heating consisting of two separate heating steps—an initial step and a final step—which are carried out separately from one another with the second step following the first so as to minimize any decrease in the temperature of the heated material as the material passes from one step to the other, the material being treated being heated during the initial step by contact with a hot gas stream as the material is agitated for a period and to a temperature which together are sufficient so that if any further heating would occur pyrolysis products of the kerogen would be vaporized to a noticeable extent, the material being treated being further heated during the second, final step by contact with a different hot gas stream as this material is agitated for a period and to a temperature which together are sufficient to produce and volatilize substantially all the volatiles which can be obtained or derived from the mineral material being processed, and then separating this material from the volatiles produced during the second final heating step.

It will be appreciated from the preceding that the process does not contemplate a single heating step in which the raw material is gradually brought up to a temperature at which volatiles are obtained and vaporized in a single retort or similar item of equipment. In practicing the present invention the two different heating steps are separately carried out under separate conditions which reflect the differences in what occurs during these two separate heating steps. This is considered to be important.

BRIEF DESCRIPTION OF THE DRAWING

Because of the nature of the present invention it is best more fully described with reference to the accompanying drawing in which:

The FIGURE is a diagrammatic flow sheet showing a presently preferred manner of carrying out the process of the present invention.

It will be realized from a consideration of the remainder of this description and from the various claims forming a part of this specification that the invention is not limited to a process carried out utilizing the exact items of equipment illustrated in the drawing or carried out in exact conformity with all of the details which will be apparent from a consideration of the drawing and the remainder of this specification. Those skilled in the field of utilizing process steps to recover oil from various naturally occurring deposits by pyrolysis will realize that the invention embodies the concepts summarized or defined in the appended claims and that it is possible to utilize these in various different manners in accordance with routine design ability in the field of recovery of oil from naturally occurring deposits.

DETAILED DESCRIPTION

In the practice of the present invention a mineral matrix permeated or interpolated with kerogen such as, for example, common oil shale is introduced into an initial rotary kiln 10 through the use of a conventional airlock 12 and a feed chute 14 through a hood 16 outside of a hot gas stream (not shown) which is interjected into the upper end 17 of the kiln 10 through a gas inlet pipe 18. This chute 14 terminates in an outlet 20 generally to one side of and below the pipe 18 so that any material moved through it will not be directly contacted by the hot gas stream passing through the inlet pipe 18 as this material is introduced into the kiln 10. Preferably a conventional seal 22 is provided between the hood 16 and the kiln 10. The seal 22 will prevent gas escaping to the ambient from the interior of the kiln 10 in the event the pressure within this kiln 10 exceeds the ambient pressure. Similarly if the kiln 10 is operated at less than ambient pressure, the seal 22 will prevent leakage of air into the kiln.

The raw material deposited within the kiln 10 will preferably be deposited upon conventional, known spiral flanges or sections 24 which will facilitate heat transfer to this material and which will tend to facilitate movement of this material generally toward the discharge end of the kiln 10 as the kiln 10 rotates. Equivalents of the sections 24 can of course be employed and/or if desired, such sections or their equivalents can be omitted. Thus, for example, known scoops can be mounted on the kiln 10 so as to move raw material into the interior of the kiln 10 without the raw material being contacted by the hot gas stream as it is introduced into the kiln. Also, known type lifters (not shown) can be employed in the kiln 10 in accordance with conventional practice.

As the kiln 10 is operated the raw material introduced into it through the chute 14 will gradually pass from the area of the sections 24 so as to move generally across and along a conventional refractory lining 26 or another related lining (not shown) such as a heat resistant steel lining used in combination with such a refractory lining within this kiln 10. This lining 26 will of course act as a heat transfer media so as to indirectly convey heat from the hot gas stream into the load of raw material which moves through the kiln 10. As the kiln 10 is operated the hot gas stream used within it will be separated from the material being processed as a result of the action of gravity within a hood 28 at the lower, discharge end 30 of the kiln 10. Another seal 22 is preferably used between the hood 28 and this end 30 for the same purpose as the seal 22 previously described.

This kiln 10 when operated as described constitutes a form of a concurrent heat exchange apparatus in which the raw material is contacted with the hot gas stream as this raw material is continuously agitated. This agitation facilitates heat transfer; in addition, it causes grinding of the material being processed. Because of the normal manner in which a rotary kiln operates, as the process of this invention is practiced normally only very fine dust of less than about 50 micron particle size will be picked up by or conveyed by the hot gas stream as heat is conveyed to substantially all the raw material present. This is important in minimizing dust problems as heating occurs within this kiln 10.

The degree of heating within the kiln 10 is considered to be quite important. Preferably this kiln 10 is operated so that substantially no volatilization of any products derived from kerogen takes place within it. A comparatively minor amount of volatilization from kerogen is considered to be inevitable and as a result up to about a 3% increase in volume of the hot gas stream within the kiln 10 may be anticipated. Such a limited amount is normally insufficient to be significant from a process standpoint as far as the operation of the kiln 10 is concerned. Thus, it will not be significant from the point of view of significantly influencing thermal efficiency and/or gas volumes in connection with the kiln 10. As a consequence of this substantially no or relatively limited expansion of hot gas stream within the kiln 10, the kiln 10 and the auxiliary equipment used with it need only be designed with reference to the amount of and temperature of the hot gas used for heating purposes in the kiln 10 and need not be designed with reference to any volumetric changes in gas volume resulting from the operation of the kiln 10. This is considered important in maximizing the capacity of the equipment used or in minimizing the size of the equipment required and in facilitating the operation of the complete process.

As a consequence of this the kiln 10 need only be operated with reference to its specific function—the initial heating of the raw material process. In order to accomplish this heating as expeditiously as possible, the hot gas stream supplied through the inlet pipe 18 may be as hot as it is reasonably convenient to obtain utilizing relatively inexpensive equipment. From an overall "economic" standpoint it is considered that this temperature should be from about 1800° F. (982° C.) to about 2700° F. (1482° C.). The comparatively high temperature of the hot gas stream supplied will normally not be detrimental to the kiln 10 because of the comparatively rapid transfer of heat from the hot gas stream to the raw material introduced into the kiln 10. Both the hot gas stream will be cooled and the raw material will be heated at related rates such that both will approach the same temperature reasonably rapidly. This temperature should be close to but preferably not more than 50° F. (10° C.) below the temperature at which pyrolysis of the kerogen will be apparent.

It will be realized that this involves a number of related factors such as, for example, the relative quantities of the raw material the gases within the hot gas stream, the rates at which both are moved through the kiln 10 and the efficiency of particular kiln structure used as the kiln 10 in promoting heat transfer. Preferably the kiln 10 is operated so that at the lower end 30 of the kiln 10 both the hot gas stream and the raw material treated are at substantially the same temperature. This is considered quite important in achieving heat economy and in achieving process temperature control.

The intended avoidance of volatilization products derived from the kerogen involves essentially time-temperature related reactions which produce these products. This involves the consideration that kerogen may be held at a first comparatively low temperature for a comparatively long period before producing any such products or may be held at a second higher temperature for a much shorter period before producing such products. Since the production of volatile pyrolysis products of kerogen becomes comparatively rapid, at a temperature of from about 600° F. (316° C.) to about 700° F. (371° C.) it is preferred to operate the kiln 10 so that the material being heated within the kiln 10 is discharged substantially as soon as this material reaches a temperature within this range. Preferably such material should not be heated to a temperature greater than about 700° F. (371° C.).

The precise temperature within this range which should be achieved for maximum efficiency will apparently vary depending upon the nature of the material being processed and the presence of any possible secondary materials within the raw material present which might promote the degradation of the kerogen. With oil shale of a type prevalent in the State of Colorado, U.S.A., it is believed that the raw material in the kiln 10 should be heated to a temperature of no greater than about 670° F. (354° C.) and preferably of about 650° F. (343° C.) so as to minimize the production of vaporous products in the kiln 10.

The maintenance of a desired temperature within the kiln 10 is considered to require careful control of the process conditions within this kiln 10 so as to control combustion of the kerogen or kerogen products within the kiln 10. In accordance with this invention this is achieved by regulating the composition of the hot gas stream used so that this hot gas stream contains insufficient oxygen for there to be any significant or noticeable flaming or visible combustion to occur within the kiln 10 or in the hood 28. Because of the possibility of such combustion occurring or of possible formation of an explosive mixture derived from the kerogen within the kiln, it is considered that the hot gas stream entering the kiln 10 through the inlet pipe 18 should contain either no oxygen or up to a maximum of about 4% by volume of oxygen. When a comparatively small amount of oxygen as noted is used, some minor amount of oxidation or combustion tending to produce heat and gases will occur, but in general at the gas temperatures within the kiln 10 such amounts are so minor as to be capable of being neglected.

It is important to note several factors relative to the preferred manner of operating the kiln 10. The total heat supplied to the interior of the kiln 10 is preferably carefully regulated by controlling the content and the temperature of the hot gas stream passing through the pipe 18 into the kiln 10. This in turn "sets" or "controls" the total sensible heat available within the kiln 10 for use in heating the raw material processed within this kiln 10. Because the kiln 10 is operated in a concurrent manner this total heat input into the kiln 10 can be and is utilized so as to accurately control the temperature to which this material is heated within the kiln 10. Preferably, this control is achieved by first measuring the temperature of the gas leaving the kiln 10 through the use of a known temperature controller 29 and then by utilizing this measurement to control the heat input into the kiln 10. This of course is important so that only the desired amount of heating is achieved within the kiln 10. By controlling the heat supplied to the interior of the kiln 10 in the manner noted comparatively fast responsive control of process conditions in the kiln 10 can be achieved. This is considered to be important.

The heated solid material separated in the hood 28 is conveyed through another airlock 32 and thence through another inlet chute 34 into the interior of a hood 36 around an inlet pipe 38 for hot gases into the hopper end 39 of a second or pyrolysis kiln 40. The kilns 10 and 40 may be of the same or substantially the same construction. It is considered, however, that it may be advisable to form the kiln 40 so that it is more resistant to damage by higher temperatures than the kiln 10. Preferably the dimensions of the kilns 10 and 40 should be carefully proportioned to one another so that the kiln 10 will always be able to handle the maximum amount of heated material conveyed to it through the chute 34 through the operation of the kiln 10 and so that it is adequately sized so as to be able to handle the vaporization products which are obtained as a result of its operation in carrying out the process without such vaporization products causing increases in gas velocities in the kiln 40 to a level which might tend to promote excessive dust loss or "carry-over" of solids treated in these kilns 10 and 40.

The kiln 40 includes another discharge hood 42 at its lower end 44. The airlocks 32 and 46 used corresponds to the airlock 12 previously described. The chute 34 corresponds to the chute 14 previously described; the hood 36 used with the kiln 40 corresponds to the hood 16; the inlet pipe 38 corresponds to the pipe 18 indicated in the preceding; the hood 42 corresponds to the hood 28 previously discussed; and the kiln 10 also includes a temperature controller 41 corresponding to the temperature controller 29 indicated in the preceding. Because of the close relationship between the kilns 10 and 40 it is not considered necessary to discuss the use of lining, lifters or the like within the kiln 40. The hoods 36 and 42 are used in connection with further seals 22 designed to prevent leakage.

The operation of this kiln 40 involves a number of factors which are related to the operation of the kiln 10. Essentially the kiln 40 is another heat exchanger which is designed to convey heat from a hot gas stream supplied through the inlet pipe 38 so as to bring the temperature of the material introduced through the chute 34 up to a temperature at which significant vaporization of products resulting from pyrolysis of kerogen occur. Preferably the chute 34 used in conveying this material from the hood 28 into the kiln 40 is comparatively short and is reasonably insulated so that substantially no significant cooling takes place during the movement of the material between the kilns 10 and 40. As a result of this the kiln 40 will normally be operated so that the previously heated material is brought up to a temperature at which significant products of pyrolysis are formed quite rapidly. As with the kiln 10 a concurrent heating action is achieved with the kiln 40 which will result in both a decrease of the hot gas stream temperature and a further increase of the temperature of the previously heated material as rapidly as reasonably possible.

Here again, time-temperature reactions are involved. The kiln 40 is preferably operated so that the dwell times of material within the kiln in connection with the temperature developed in the material heated are in excess of the time and temperature necessary to achieve substantially complete volatilization of all volatiles which can be produced, obtained or derived from the raw material used. The kiln 40 should, however, be operated so that this time-temperature period is sufficiently limited so that no heat is utilized in heating the material treated beyond this point or in excess of this amount. This will avoid or minimize any tendency toward modification in the mineral matrix of the kerogen containing material treated.

It will be realized that these factors involve a number of considerations. In general, it is preferred that the material within the kiln 40 will not be heated to a temperature in excess of about 1050° F. (566° C.) since with most kerogen containing minerals or minerals containing hydrocarbon compositions similar to kerogen, so-called "endothermic" or non-productive reactions or physical affects such as sintering will tend to take place in time above this temperature It will be emphasized, however, that this specific temperature which may be considered as being just below the temperature at which such non-productive reactions or effects become excessively apparent is not a fixed temperature, but will vary depending upon a number of factors, such as the mineral matrix of a specific material being heated.

Fortunately it is not normally necessary to reach a temperature reasonably approaching this 1050° F. (566° C.) figure in deriving substantially all of the recoverable hydrocarbon values from within kerogen. Substantailly all of such hydrocarbon values can normally be obtained if the kerogen is brought to a temperature of from about 800° F. (427° C.) to about 900° F. (482° C.) for a period of from about 10 minutes to about 20 minutes. Since temperatures from within this latter range can be easily achieved within the kiln 40 and are not considered to be detrimental to process equipment life, it is preferred to utilize a temperature within this range. It is considered, however, that broadly desired results can be achieved utilizing temperatures from about 750° F. (399° C.) to about 1000° F. (538° C.).

When temperatures approaching the latter are employed there is always the danger that some heat may be wasted in accomplishing a function other than the pyrolysis of the kerogen and that in some cases the evolution of vaporization products as noted will be so rapid as to possibly promote dust loss much in the manner in which the evolution of carbon dioxide in calcined lime will tend to a degree promote dust loss. When temperatures of from about 750° F. (399° C.) to about 800° F. (427° C.) are employed as a maximum temperature in treating kerogen and its products in the kiln 40, the times required to achieve the desired conversion of kerogen are considered to be unnecessarily long. This in turn results in comparatively large equipment being required if comparatively large quantities of material are to be treated within a limited time period.

The temperature of the hot gas stream introduced into the kiln 40 can, of course, be varied signficantly. In order to achieve a desired degree of heating as rapidly as possible, it is considered that the hot gas stream conveyed through the inlet pipe 38 should normally be as hot as reasonably possible without the temperature of this stream causing abnormal problems in conjunction with the construction of the pipe 38 or the apparatus used to produce the hot gas stream. It is preferable for this stream to be within the same temperature range as the stream used with the kiln 10. In general, the lower the temperature of the hot gas stream the slower the material is heated within the kiln 40.

It will of course be recognized that significant quantities of combustible gases and vapors will be "liberated" in the kiln 40. Because of the combustible character of such gases and vapors it is considered mandatory to limit the oxygen content of the hot gas stream supplied to the kiln 40 so that this hot gas stream contains no more than about 4.0% by weight oxygen. When any oxygen is present in this hot gas stream such oxygen will normally react with hydrocarbons given off or vaporized in the kiln 40 and with residual carbon or hydrocarbon material on the material being processed, and this in turn will cause a degree of heating within the kiln 40 as well as a change of the anticipated gas volume present. Such reactions are desirable as providing heat but are desirable only if they do not lead to uncontrolled combustion or excessive heating of the material being processed. For this reason and because of the possibility of the production of an explosive mixture within the kiln 40 it is considered desirable to carefully minimize the oxygen present in the hot gas stream of the kiln 40 to within a range as indicated.

It is considered important to note several factors relative to the preferred manner of operating the kiln 40 which are related to factors as discussed in the preceding relative to the preferred manner of operating the kiln 10. These two kilns 10 and 40 are operated in manners which are closely related so as to achieve corresponding advantages. In the kiln 40, however, heat is available from two different sources so as to promote or cause pyrolysis. Thus heat is available from the hot gas stream supplied to the kiln and is also available as a result of such combustion as takes place within the kiln 40. The amount of such combustion can be controlled or regulated by controlling or regulating the oxygen content. Thus, it is possible to eliminate heat production in the kiln 40 as a result of combustion by operating the kiln utilizing a non-oxidizing hot gas stream. This, however, is not considered preferred because it is considered simple and economic to obtain heat to promote pyrolysis as a result of limited combustion within the kiln 40. Because of this, the total available heat utilized for causing pyrolysis within the kiln 40 is preferably regulated by controlling both the volume and temperature and oxygen content of the hot gas stream supplied to this kiln. It is considered easier to so regulate this hot gas stream than it is to regulate the combustion within the kiln. Any such regulation is, of course, for the same purpose as the temperature regulation in connection with the kiln 10. The temperature controller 41 is preferably utilized in achieving this regulation. This controller 41 is operated in the same manner as the controller 29. In the kiln 40 it is important to supply to the material treated an amount of heat necessary to cause desired pyrolysis such that the discharged gas and vapor corresponds to a not "overheated" processed mineral material. By controlling the heat available, the fast responsive control of process conditions in the kiln 10 can also be achieved in the kiln 40.

Normally the retorted material obtained as a result of operation of the kiln 40 will be discharged from the hood 42 through the use of an airlock 46. Because of the heated character of this retorted material, some heat value can be obtained from it in accordance with conventional practice such as generation of steam. The heated mineral material resulting from the parctice of the two separate heating steps indicated will also normally contain a comparatively limited amount of adherent carbon which will not make it objectionable for most common uses, such as, for example, as land fill. Depending upon a number of factors this heated material may contain sufficient carbon and hydrocarbons so that it may be desirable to burn it in order to produce heat. The precise use of any retorted minerals obtained in the manner noted will depend upon the need for this type of material, the precise mineral content of the retorted material obtained, and other factors related to the economics of disposing of the heated mineral product and heat recovery.

The mixture of hot gas stream used for heating purposes and the vaporized hydrocarbon oil or oil-like products produced through the operation of the kiln 40 will normally be conveyed from the hood 42 through a conventional pipe 47 through a conventional dust removal apparatus (not shown) and then will be separated from the non-condensible gases in a conventional manner. Any gaseous products obtained in this manner which cannot be conveniently separated or recovered by standard techniques may be utilized as either the sole or as part of the fuel for either or both of two different combusters 52 or 54 of a known or conventional character.

These combusters 52 or 54 are normally operated so that the fuels used are mixed with air and are burned in them utilizing burners 56 with what may be referred to as secondary air or recycled gases from the kilns 10 and 40. If desired, various conventional or known expedients may be utilized in recovering heat value from the hot gases produced by or discharged by the kilns 10 or 40. Because such matters are well within conventional or known knowledge, it is not considered necessary to encumber this specification with a detailed discussion of it. Neither is it considered necessary to insert in this specification a detailed discussion of all conventional or known expedients for operating the kilns 10 and 40 to obtain the results achieved.

One important facet of the present invention relates to the fact that the kilns 10 and 40 may be individually controlled in such a manner that the process of the present invention will not be interferred with as a result of variations in the raw material treated or as a result of minor variation in the operations of the combusters 52 or 54 or of the kilns 10 or 40. Because of the manner in which these kilns 10 and 40 operate, the present invention can accommodate raw material of a wide range of sizes. Thus, for example, the process of the present invention can be carried out utilizing rotary kilns so as to satisfactorily recover hydrocarbon values from extremely fine, such as −35 mesh standard Tyler screen size raw materials or from raw materials in the nature of chunks or lumps of up to several inches in diameter.

It will be apparent from the preceding that the two kilns 10 and 40 are utilized in a series or sequential manner. This is considered to be important as a result of a combination of different, interrelated factors. One of these relates to the total volumes of the non-condensible or inert gases which have to be handled in connection with the process described in the preceding. In any process employing a rotary kiln, the kiln is normally dimensioned or sized so as to adequately accommodate the gas flow through the kiln and so that such gas flow is at a mass velocity such that effective heat transfer is achieved. The process described in the preceding recognizes that kilns of a comparatively limited size in terms of the quantity of solid material capable of being processed within them can be utilized as the kilns 10 or 40 as a result of a recognition of the different effective volumes of gases required or encountered during heating of the raw material below a pyrolysis temperature and during heating at a temperature such that pyrolysis takes place.

During heating of oil shale or the like within the lower of these two ranges for preheating purposes, a kiln need only be sized so as to be utilized with a volume of hot gas which, as the kiln 10 is operated, is sufficient to achieve only the desired preheating in the kiln 10. As opposed to this the kiln 40 must be sized not only to accommodate the volume of gas of the temperature used necessary to cause or promote the desired or intended pyrolysis of the composition, but must in addition be sized or dimensioned so as to accommodate the vapors produced as a result of the pyrolysis, and in addition to accommodate any change in the total volume of gas anticipated as a result of combustion occurring within this kiln 40. As a result of these considerations in accordance with this invention materials such as oil shale are treated in separate steps, each of which can be (and is) maximized from an economic standpoint in accordance with what is accomplished during it.

The use of the kilns 10 and 40 as described in series in accordance with this invention has an advantage which is related to the preceding advantages but is somewhat different from them. This advantage relates to the maximazation of the condensable hydrocarbon concentration of the gas mixture from which oil is ultimately recovered. This in turn relates to the quantities of hot gas or gases needed to achieve the desired heating of oil shale or the like in order to vaporize various hydrocarbons which are ultimately recovered as oil. With the present invention, the kiln 10 is operated so that effectively no oil compounds are vaporized in this kiln.

As a result, the gases passing from this kiln 10 do not have to be taken into consideration in determining the capacity of the equipment necessary in order to condense vaporized hydrocarbons as are obtained in a gas mixture from the kiln 40. These gases exiting from the kiln 10 are at a temperature which can be considered as comparatively nominal. As a consequence of this, the operation of the kiln 10 is of a reasonably thermally efficient character. Further, because of the nature of the gases exiting from the kiln 10, these gases can be "cleaned up" for dissemination into the atmosphere at a comparatively nominal cost with comparatively little difficulty.

The gases exiting from the kiln 40 are at a higher temperature than the gases exiting from the kiln 10. This, of course, is an indication that the kiln 40 is less efficient from a thermal standpoint than the kiln 10. If only a single kiln was used in lieu of both kilns 10 and 40, the efficiency of such a single kiln would not normally be as great as the efficiency of such two kilns operated in a series in accordance with this invention. The exit gas from the kiln 40 is, of course, less in volume than the volume of the exit gas which would be present if only a single kiln was used.

As a result of this, the exit gas from the kiln 40 will normally only correspond to the amount of gas required to accomplish the desired heating in the kiln 40 and will not have "extra" essentially inert gas such as is obtained from the kiln 40 and as would be present if the entire heating operation was carried out in a single kiln. As a result of this, the concentration of the condensable hydrocarbons in the exit gas from the kiln 40 is such that smaller equipment can be used to condense such hydrocarbons than if such equipment had to accommodate the total gas volume which would be required if a single kiln were used or had to accommodate the exit gas volumes of both the kilns 10 and 40.

I claim:

1. A process for recovering or obtaining hydrocarbon compounds from naturally occurring deposits of a mineral matrix interpolated with kerogen which includes heating the raw material employed for a period and at a temperature which together are sufficient so that pyrolysis products from the kerogen are produced and volatilized and then separating these products from the remainder of the mineral matrix in which the improvement comprises:

the heating consisting of two separate heating steps—an initial step and a final step—which are carried out separately from one another by concurrent movement of a hot gas stream and the material being heated through the kiln in which the step is performed with the second step following the first so as to minimize any decrease in the temperature of the heated material as the material passes from one step to the other, the material being treated being heated during the initial step by contact with a hot gas stream containing insufficient oxygen for there to be any noticeable combustion to occur during this initial step, as the material is agitated for a period and to a temperature which together are sufficient so that if any further heating would occur pyrolysis products of the kerogen would be vaporized to a significant extent, separating the material heated during the initial step from the hot gas stream used to heat this material, The material being treated being further heated during the second, final step by contact with a different hot gas stream as this material is agitated for a period and to a temperature which together are sufficient to produce and volatilize substantially all the volatiles which can be obtained or derived from the mineral material being processed, and then separating this material from the hot gas stream and the volatiles produced during the second final heating step.

2. A process as claimed in claim 1 wherein:

said initial heating step is performed by contacting raw material at ambient temperature with a hot gas stream at a temperature of from about 1800° F. to about 2700° F.

3. A process as claimed in claim 2 wherein:

said raw material and said hot gas stream during said initial heating step are heated and cooled, respectively, to about the same temperature at which substantially no volatilization products of kerogen are formed but which is close to such a temperature.

4. A process as claimed in claim 3 wherein:

said temperature is no greater than about 700° F.

5. A process as claimed in claim 1 wherein:

said hot gas stream used in said initial heating step contains no more than about 4% by weight oxygen.

6. A process as claimed in claim 1 wherein:

said final heating step is performed by contacting heated material from said initial heating step with a hot gas stream at a temperature sufficient so as to further heat material in said final step to a temperature which is not in excess of about 1050° F. for a time period sufficient to cause pyrolysis of substantially all of the hydrocarbon values in the kerogen present within said material.

7. A process as claimed in claim 6 wherein:

said hot gas stream in said final heating step is at a temperature sufficient to heat the material being further heated in said second step to a temperature of from about 750° F. to about 1000° F. for a period sufficient to substantially pyrolyze all of the recoverable hydrocarbon values in the kerogen present within said material.

8. A process as claimed in claim 7 wherein:

said material is heated in said second step to a temperature of from about 800° F. to about 900° F. for a period of from about 10 to about 20 minutes.

9. A process as claimed in claim 1 wherein:

said hot gas stream used in said final heating step contains no more than about 4% by weight oxygen.

10. A process as claimed in claim 1 wherein:

said hot gas streams employed in said steps are separate gas streams, each of said streams containing no more than about 4% by weight oxygen.

11. A process as claimed in claim 10 wherein:

said initial heating step is performed by contacting raw material at ambient temperature with a hot gas stream at a temperature of from about 1800° F. to about 2700° F., said raw material and said hot gas stream during said initial heating step are heated and cooled, respectively, to about the same temperature at which substantially no volatilization products of kerogen are formed but which is close to such a temperature, said hot gas stream in said final heating step is at a temperature sufficient to heat the material being further heated in said second step to a temperature of from about 750° F. to about 1000° F. for a period sufficient to substantially pyrolyze all of the recoverable hydrocarbon values in the kerogen present within said material.

12. A process as claimed in claim 11 wherein:

said temperature is not greater than about 700° F., said material is heated in said second step to a temperature of from about 800° F. to about 900° F. for a period of from about 10 to about 20 minutes.

* * * * *